US005505151A

United States Patent [19]

Haaland

[11] Patent Number: 5,505,151

[45] Date of Patent: Apr. 9, 1996

[54] DEVICE FOR THE PRODUCTION OF OIL/PETROLEUM PRODUCTS AT SEA

[75] Inventor: Ole J. Haaland, Snarøya, Norway

[73] Assignee: Kvaerner A.S., Oslo, Norway

[21] Appl. No.: 367,177

[22] PCT Filed: Jun. 28, 1993

[86] PCT No.: PCT/NO93/00101

§ 371 Date: Dec. 28, 1994

§ 102(e) Date: Dec. 28, 1994

[87] PCT Pub. No.: WO94/00333

PCT Pub. Date: Jan. 6, 1994

[30] Foreign Application Priority Data

Jun. 29, 1992 [NO] Norway ..... 922562

[51] Int. Cl.[6] ..... B63B 35/28

[52] U.S. Cl. ..... 114/26; 114/65 R

[58] Field of Search ..... 114/26, 72, 73, 114/230, 270, 65 R; 441/3–5

[56] References Cited

U.S. PATENT DOCUMENTS

| | | | |
|---|---|---|---|
| 3,262,411 | 7/1966 | Kaltenecker | 114/26 |
| 3,766,875 | 10/1973 | Baki | 114/73 |
| 4,170,187 | 10/1979 | Schirtzinger | 114/270 |
| 4,459,930 | 7/1984 | Flory | 114/230 |
| 4,568,522 | 2/1986 | Corbett | 114/270 |
| 4,715,721 | 12/1987 | Walker et al. | 114/72 |
| 4,846,088 | 7/1989 | Fanse et al. | 114/72 |

FOREIGN PATENT DOCUMENTS

| | | |
|---|---|---|
| 2419057 | 10/1975 | Germany . |
| 2707628 | 8/1978 | Germany . |
| 1464332 | 2/1977 | United Kingdom . |
| 1475813 | 6/1977 | United Kingdom . |
| 1486572 | 9/1977 | United Kingdom . |
| 1524402 | 9/1978 | United Kingdom . |
| 2063182 | 6/1981 | United Kingdom . |

*Primary Examiner*—Stephen Avila

*Attorney, Agent, or Firm*—Merchant, Gould, Smith, Edell, Welter & Schmidt

[57] ABSTRACT

A vessel for use in the refinement or production of oil/petroleum products at sea at a location at a distance from the coast is designed as a ship (1) of the lash type, in which there are integrated a number of barges (2) which can be removed from the ship's hull and used as independent transport vessels for the transport of products to and from shore. In the ship there is integrated manufacturing or production equipment in a unit (4). This unit (4) can also be provided in a barge which is part of the lash construction. The manufacturing equipment in the unit (4) is preferably positioned close to the ship's means of propulsion and control. In the ship's construction between the barges and the production equipment (2, 4), there are integtrated transport systems for the products obtained.

3 Claims, 1 Drawing Sheet

DEVICE FOR THE PRODUCTION OF OIL/PETROLEUM PRODUCTS AT SEA

Figure 1:
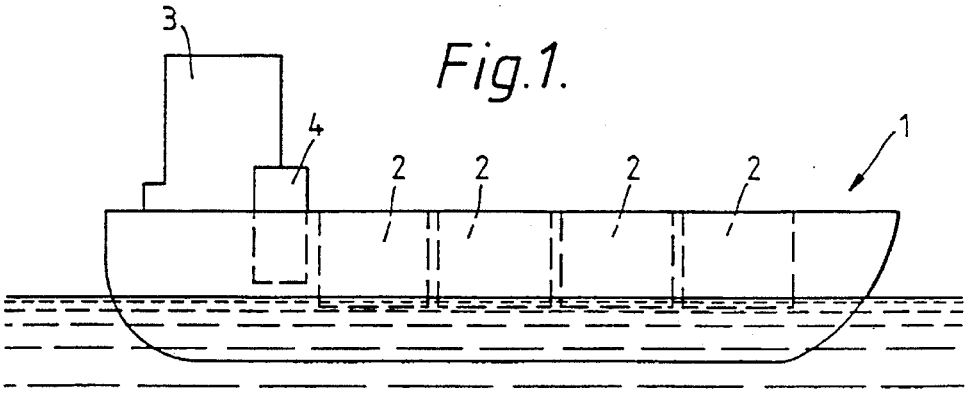

The invention concerns a device for the refinement or production of oil/petroleum products at sea on a factory or production ship. The invention is thereby also intended to include devices where refinement/production is conducted on a combination of land and sea-based installations. The expression ship is intended to cover any type of installation at sea.

In the extraction of oil or petroleum at sea, the production of oil products, i.e. the extraction of these from the oil-bearing strata, is normally conducted on board oil installations. In the production process gas is often included and until now it has been difficult to exploit this by means of those methods in use to date. In smaller oilfields and in test drillings, oil production vessels have also been used to some extent, in which the oil is brought up from the reservoir and placed in intermediate storage in the ship's tanks before being further transported by another ship to shore or to a further refinement site. Oil production ships of this kind have proved to be a rational solution for their special purposes but in reality constitute a relatively expensive solution, at any rate when it comes to the normal extraction of oil/petroleum products.

The concept of exploiting oil/petroleum products in or close to the extraction site has also been contemplated previously, by locating refining or factory equipment there, either on a platform or on a special ship for this purpose, which may be capable of producing electrical energy for bringing the oil ashore. Such ideas have been under consideration as a replacement for gas power stations in order to keep the pollution away from shore. However, no solution has been found to date as to how to implement this kind of production or further refinement of produced oil/petroleum products in an economically justifiable fashion, which would enable the operation to be conducted in a profitable manner.

The object of the invention is to provide a device which makes this kind of production and further refinement possible and which will allow oil/petroleum products to be produced and brought ashore in an economically justifiable way and/or perform the refinement and further conversion of the products into more valuable products, which can also be transported ashore or to a utilization site in a more rational manner.

These objects are achieved with a device which is characterized by the features in the patent claims presented.

The invention also concerns the employment of a lash-ship for the production and bringing ashore of carbon black and possibly hydrogen.

The term lash-ship refers to a ship of the type which is designed for the transport of a number of barges or smaller cargo vessels, which can be incorporated in the lash-ship in such a manner that the barges can be launched and act as separate ships. Such barges can be provided both over and under the ship's main deck, or they can be designed as releasable segments of a larger ship's hull. The barges can also be provided midships, thus giving the ship a catamaran-like design. Ships of this kind are known in a number of different designs.

This type of ship has been designed exclusively in order to facilitate and rationalize the transport of different types of goods, where the goods which have to be transported will be difficult to load on board larger ships, while at the same time the transport of the goods will be considerably simplified by using larger ships. The intermediate solution has therefore been developed whereby goods can be loaded on board smaller ship units which are taken aboard the main ship or integrated in the main ship by some means and at the delivery location they are again transported off the ship by means of the smaller units. This type of ship has not been used within the oil extraction field, nor has it been a solution to the transport problem which has existed, viz. bringing ashore large amounts of oil.

In the invention it has been recognized that major advantages can be obtained by designing a production vessel intended for test drillings or test extractions, the exploitation of small or otherwise unprofitable oilfields or the so far unexploited gas in larger fields, in the form of a lash-ship. The possibility is thereby obtained of bringing oil ashore more or less continuously in shuttle traffic, while at the same time there will at all times be a store available which can be replenished in the event of bad weather when small ships cannot be sent out. Thus when production is low, a continuous distribution net can be maintained for the extracted products.

The invention has, however, proved to be particularly advantageous in connection with the refinement of oil products and especially the extraction of oil/gas, and in pure gas fields. At present it is a major problem to bring gas ashore from a gas field and this has had the result that a number of gas fields, especially smaller fields, have not been exploited. The ability to perform a further refinement or decomposition of the gas from the oilfield on the spot in a ship designed for the purpose according to the invention, has also made it possible to conduct an economically justifiable exploitation of these marginal gas sources and to be able to bring the product ashore in a practical and successful way. It has proved to be particularly advantageous to provide a device for the decomposition of hydrocarbons, e.g. a plasma torch, on board the ship. This enables carbon black to be produced which is a pure carbon product which constitutes a valuable raw material in connection with the rubber industry, for the production of electrodes, etc. In addition hydrogen will be produced which can be used, e.g., for the generation of electrical power or the hydrogen can also be transported ashore in the ship's barges for further exploitation. Since the gas is converted into high-grade products which do not take up much room, the finished products of this further refinement will be able to be brought ashore in a very rational way. At the same time this invention represents a substantial reduction in waste gases which are dangerous to the environment.

On the basis of the invention it could also be possible to design the production unit or the refinement unit as a barge section, thus allowing the production equipment to be replaced when required according to the purpose for which the ship is being used.

It will be necessary to provide transport devices for the products obtained from the production unit to the lash-ship's barges. Such equipment is not part of the conventional equipment of a lash-ship, this being a ship which is intended for the transport of barges and nothing else.

Figure 2:
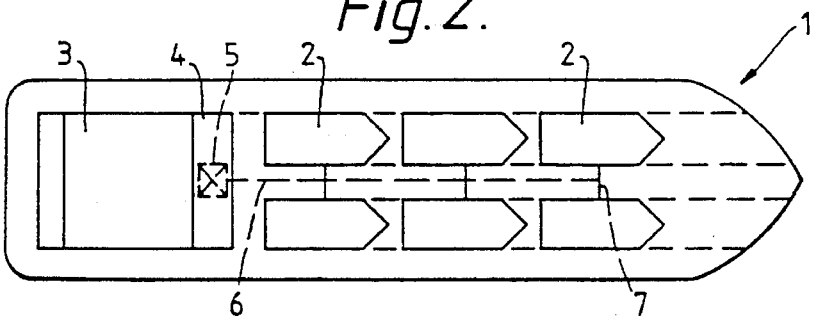
Figure 3:
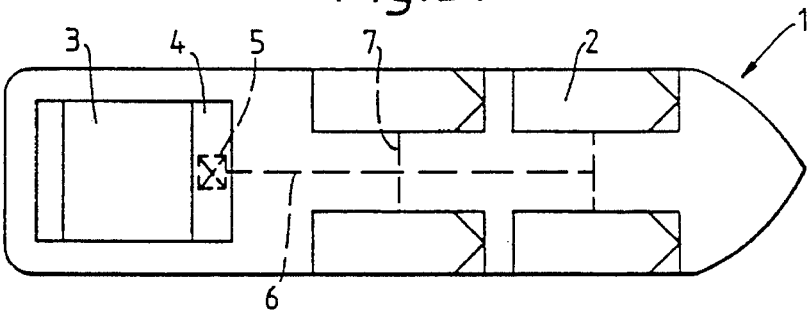
Figure 4:
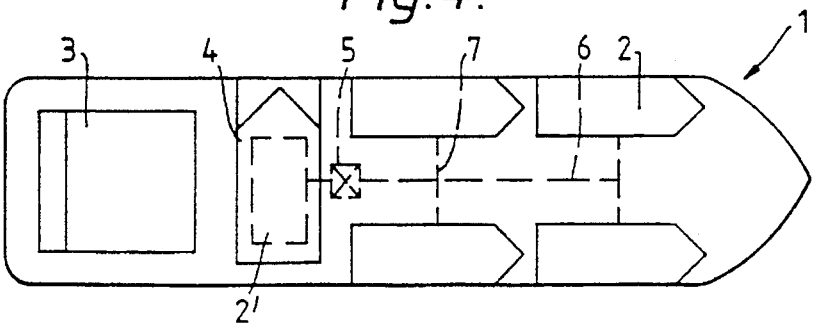

The invention will now be described in more detail by means of a drawing which comprises:

FIG. 1 a purely schematic side view illustrating the basic principle of a lash-ship, and FIGS. 2–4 three schematic elevations illustrating the various designs of a device according to the invention.

The drawing is not intended to be viewed as anything but an illustration of the principles involved in the construction of a device according to the invention, since, as mentioned above, a lash-ship can be designed in a number of different ways. The invention is not dependent on the actual design of the lash-ship, but is concerned with the utilization of such designs in connection with offshore production and further refinement of offshore products.

Thus FIG. 1 shows a ship 1 of the lash type, which is equipped with barges 2 which can either be removed at the front of the ship, e.g. in the design of the ship 1 as a catamaran hull, or they can be removed in the lateral direction, either as sections of the ship or through hatches. Alternatively the front of the ship can be opened to enable the barges 2 to be removed one after the other in this direction.

In the aft area of the ship, behind the releasable barges, the main part 3 of the ship is provided, and in this there is also incorporated, e.g., manufacturing equipment for further refined products based on gas or oil. This unit is indicated by 4. The device according to the invention is especially suitable for use in connection with minor gas finds, thus enabling the further refinement unit 4 to be used, e.g., as a device for the decomposition of hydrocarbons, e.g. a plasma torch.

FIG. 2 illustrates in a schematic overhead view a device according to the invention, where the unit 4 is replaced with production equipment for the extraction of gas from a submarine reservoir. This device is indicated by 5. To the barges 2 goes a pipe system which is generally indicated by 6 with branch pipes to the individual barges and/or container tanks, indicated by 7. This transport system will pass gas or oil on directly from the production unit 5 and fill up barges, which after being filled can be moved out of the ship 1 and transported to shore. By conducting a shuttle transport of these barges it will be possible to maintain at all times a sufficient supply of empty barges and/or container tanks in the ship or in the vicinity of the ship, thus enabling production to continue even in bad weather when the barges cannot be put to sea.

FIG. 3 illustrates a variation of a lash-ship where the barges 2 are meant to be removed in the lateral direction. Here too there is a transport pipe system 6 and 7 for the transfer of produced, refined products from a unit 4. In this case the unit 4 is provided as a separate unit in front of the wheel house 3.

In FIG. 4 this concept is further developed and the manufacturing or refining equipment is provided in a separate barge which is indicated by 2'. This can be connected via a pipe system 8 to the ship's propulsion devices, thus enabling power to be extracted from this for the operation of the manufacturing unit in the barge 2'. Furthermore barges 2 and a pipe system 6, 7 are used as in the previous figures. This embodiment has the advantage that if the ship's area of operation requires to be changed or if alterations take place in the field, the manufacturing unit can be replaced by quite simply removing the barge 2' and replacing it with another barge with suitable equipment. This provides a high degree of flexibility and utilization of the lash-ships.

The above gives only a general description of the different embodiments which are possible within the scope of the invention and it should be obvious that many modifications will be possible for a person skilled in the art.

The drawings illustrate only the position of the production/refinement unit in the area of the ship's propulsion system and the wheel house 3. This is an advantage in connection with the utilization of the ship's propulsion devices for the operation of the production/refinement equipment. In special cases it may be expedient to provide the production/refinement equipment in the forward section of the ship. This can be easily implemented. The entire after end of the ship is also an alternative.

I claim:

1. A vessel for use in refinement of oil/petroleum or in production of end products based on oil/petroleum at sea, at a distance from shore, which vessel comprises:

production/refining equipment;

a ship of a lash type with a plurality of appurtenant, replaceable barges;

the production/refining equipment being provided in one of the appurtenant, replaceable barges; and the ship being equipped with permanent equipment in a form having pipelines, valve stations, pumps for transferring oil/petroleum crude products or refined products respectively between the production/refining equipment and ship's storage tanks and/or the barges.

2. A vessel according to claim 1, further comprising a plurality of barges and/or container tanks both for gaseous and liquid/particulate formed products including hydrogen and carbon black.

3. A vessel according to claim 1, wherein there is provided space for the barges with the production/refining equipment in a part of a barge area of the vessel, which is positioned as far off as possible.

* * * * *